US005277413A

United States Patent [19]

Boss

[11] Patent Number: 5,277,413

[45] Date of Patent: Jan. 11, 1994

[54] ROTARY SIGNATURE GATHERING APPARATUS WITH SHEET STOP

[75] Inventor: Heinz Boss, Strengelbach, Switzerland

[73] Assignee: Grapha-Holding AG, Hergiswil, Switzerland

[21] Appl. No.: 988,458

[22] Filed: Dec. 10, 1992

[30] Foreign Application Priority Data

Dec. 19, 1991 [CH] Switzerland ..... 03781/91

[51] Int. Cl.[5] ..... B65H 39/02; B65H 29/20

[52] U.S. Cl. ..... 270/54; 271/187; 271/315

[58] Field of Search ..... 270/54, 55, 58; 271/4, 271/10, 185, 187, 198, 314, 315

[56] References Cited

U.S. PATENT DOCUMENTS

| | | | |
|---|---|---|---|
| 2,381,546 | 8/1945 | Kreider | 271/187 |
| 3,481,594 | 12/1969 | McCain et al. | 270/54 |
| 4,124,203 | 11/1978 | Müller | 270/55 |
| 4,470,588 | 9/1984 | Geiser | 270/55 |
| 4,491,311 | 1/1985 | Glanzmann | 270/54 |
| 4,735,406 | 4/1988 | Weber | 270/53 |
| 4,901,996 | 2/1990 | Schlough | 270/54 |
| 4,989,850 | 2/1991 | Weller | 270/58 |
| 5,046,711 | 9/1991 | Merwarth et al. | 271/187 |
| 5,110,108 | 5/1992 | Müller | 271/69 |

FOREIGN PATENT DOCUMENTS 0095603 12/1983 European Pat. Off. .

*Primary Examiner*—Edward K. Look
*Assistant Examiner*—John Ryznic
*Attorney, Agent, or Firm*—Darby & Darby

[57] ABSTRACT

Folded printed sheets are delivered by a first conveyor into the radially extending pockets of a turret-shaped second conveyor for delivery onto successive saddles of a gathering conveyor which transports stacks of superimposed interfitted folded sheets to a stapling apparatus. The fold lines are disposed at the leading ends of sheets which enter the pockets of the second conveyor to engage suitable abutments, and the sheets are thereupon acted upon by centrifugal force to move radially outwardly against stops in their pockets prior to being withdrawn and simultaneously partially spread out for deposition on the oncoming saddles of the gathering conveyor. The second conveyor rotates about a horizontal axis which is located at a level above the gathering conveyor and at the level of or below the discharge end of the first conveyor.

29 Claims, 2 Drawing Sheets

ROTARY SIGNATURE GATHERING APPARATUS WITH SHEET STOP

BACKGROUND OF THE INVENTION

The invention relates to improvements in methods of and in apparatus for manipulating folded sheets, for example, in machines for gathering sheets into brochures, books, pamphlets and like products.

European Pat. No. 0 095 603 discloses an apparatus which is designed to manipulate folded printed sheets and employs an endless gathering conveyor with a plurality of spaced-apart saddles each of which is designed to receive a succession of differently imprinted sheets, one on top of the other or others. Additional conveyors are provided to deliver discrete printed sheets for deposition onto successive saddles in different portions of the path which is defined by the gathering conveyor. Each additional conveyor comprises an endless chain or a like transporting element for a set of grippers which advance in the same direction as the saddles, at least in those regions where successive grippers are to drop printed sheets onto successive saddles of the gathering conveyor. The grippers engage the respective sheets at the fold lines between the overlapping panels of the sheets, and such sheets are opened up by a device which is installed beneath the additional conveyors and moves the panels of the sheets apart so that the released opened sheets can descend onto the adjacent saddles. The opening device employs a relatively fast belt conveyor which engages the front panels of sheets arriving at the opening station, and a somewhat slower second conveyor with tongs which engage the rear panels and whose mutual spacing is the same as that of the grippers forming part of the additional conveyors.

A drawback of the patented apparatus is that the movements of various conveyors, of their grippers and of their tongs must be synchronized at a plurality of different locations between the printing press which delivers the sheets to the additional conveyors and the saddles of the gathering conveyor. This can result in undesirable accumulations of sheets at the various transfer stations. Another drawback of the patented apparatus is that each and every change of format of the sheets necessitates prolonged and complex changes of setup with attendant substantial losses in output. All in all, the operation of the patented apparatus is rather complex and the number of stoppages due to malfunctioning of various components is rather high.

An apparatus for transporting sections of newspapers from a first conveyor to a spaced-apart second conveyor by a rotary turret-shaped intermediate conveyor is disclosed in commonly owned U.S. Pat. No. 5,110,108 granted May 5, 1992 to Hans Muller for "Sheet transporting apparatus".

OBJECTS OF THE INVENTION

An object of the invention is to provide a novel and improved method of delivering opened up originally folded sheets to successive carriers of a gathering conveyor in such a way that the likelihood of undesirable accumulations of improperly transported sheets is much less pronounced than in accordance with heretofore known methods.

Another object of the invention is to provide a method which renders it possible to process folded sheets at a higher frequency than in accordance with heretofore known proposals.

A further object of the invention is to provide a method which renders it possible to reduce the number of rejects without a reduction of the output.

An additional object of the invention is to provide a method which can be practiced with equal advantage in connection with the gathering of stacks of large, medium-sized or small printed paper sheets or the like.

Still another object of the invention is to provide a method which renders it possible to gather sheets in a small area and with a minimal number of transfer stations between the source of sheets (such as one or more printing presses) and a gathering conveyor.

A further object of the invention is to provide a simple, compact and inexpensive apparatus for the practice of the above outlined method.

Another object of the invention is to provide the apparatus with novel and improved means for manipulating the sheets immediately prior to deposition on the gathering conveyor.

An additional object of the invention is to provide the apparatus with a novel and improved conveyor for delivery of folded sheets to the running saddles or analogous carriers of the gathering conveyor.

Still another object of the invention is to provide the apparatus with novel and improved means for opening the sheets preparatory to deposition of such sheets on the gathering conveyor.

A further object of the invention is to provide a versatile apparatus which can manipulate larger, smaller or medium-sized sheets with equal facility and which can be rapidly converted for the processing of differently dimensioned sheets.

Another object of the invention is to provide a novel and improved production line which employs an apparatus of the above outlined character.

SUMMARY OF THE INVENTION

One feature of the present invention resides in the provision of a method of delivering to successive carriers of a series of spaced apart carriers—which are advanced in a first direction along a first path—openable (i.e., spreadable) folded sheets (e.g., printed sheets which are to be gathered into books, pamphlets, brochures or like products) each of which has a pair of overlapping panels or pages joined to each other along a fold line. The improved method comprises the steps of conveying a file of successive sheets in a second direction along a second path in a first orientation such that the fold lines constitute the leaders of successive sheets, transporting successive sheets of the file along a third path extending from a discharge end of the second path to the first path including moving successive sheets in a third direction substantially transversely of the second direction, changing the orientation of successive sheets, opening or spreading successive sheets, and depositing successive spread out sheets on successive carriers.

The first path can constitute an endless path, and the carriers can constitute saddles which extend transversely of the first direction. The method can further comprise the step of applying connectors (e.g., in the form of staples and/or stitches) to the sheets subsequent to the depositing step.

In many instances, one panel of each sheet will have a portion (sometimes called overlay fold) which projects beyond the other panel in a direction away from the respective fold line, and the spreading step then preferably comprises engaging and moving the projecting portion of the one panel away from the other panel of a sheet not later than at the first path.

The third path can constitute an endless path which is defined by a conveyor (e.g., in the form of a turret rotatable or indexible about a substantially horizontal axis) including a series of pockets with inlets for admission of successive sheets of the file at the discharge end of the second path and extending substantially transversely of the third direction. The depositing step of such method can include withdrawing the sheets through the inlets of the respective pockets, and the opening step of such method can be carried out in the course of the withdrawing step. The transporting step of the just outlined method can comprise orbiting the pockets about the aforementioned substantially horizontal axis, and the first path (or at least that portion of the first path where the carriers receive opened sheets) is preferably located at a level below such axis. The inlets of the pockets are preferably remote from the axis, and the fold lines of sheets in the pockets in the course of the transporting step are nearer to the axis than the inlets of the respective pockets. The discharge end of the second path is preferably disposed at a level above the horizontal axis, and the third direction preferably extends at least substantially at right angles to the second direction. The withdrawing step can be carried out at the first path.

Another feature of the invention resides in the provision of an apparatus for manipulating openable folded sheets each of which has a pair of overlapping panels or pages joined to each other along a fold line. The apparatus comprises a first conveyor having a plurality of spaced-apart carriers and means for moving the carriers in a first direction along a first path, a second conveyor having means for advancing a file of folded sheets in a second direction along a second path wherein the fold lines constitute the leaders of the respective sheets and which has a discharge end remote from the first path, and a third conveyor having pockets and means for transporting the pockets along a third path which extends from the discharge end of the second path to the first path and wherein the pockets move at least substantially in the first direction, at least at the first path. Each pocket has a sheet-admitting inlet, and the third conveyor further comprises a device for opening the inlets not later than when the inlets arrive at the discharge end of the second path in order to admit sheets into successive pockets, and for at least partially closing the inlets between the discharge end of the second path and the first path. Still further, the third conveyor comprises means for withdrawing sheets from the pockets, for opening or spreading the sheets and for depositing the at least partly spread out sheets on the carriers. The withdrawing means of the third conveyor preferably comprises means for locating each sheet in the respective pocket while the inlet of the pocket is closed and prior to opening or spreading of the sheet.

The carriers can include or constitute saddles which extend transversely of the first direction and the means for moving the carriers can comprise one or more endless flexible elements (e.g., one or more ropes, cables and/or chains) for pulling the saddles in the first direction.

The third conveyor preferably defines for its pockets a third path having an arcuate portion between the first and second paths, and the pockets preferably extend substantially transversely of the third path to change the orientation of sheets therein during transport from the discharge end of the second path to the carriers in the first path.

The aforementioned locating means can comprise stops which are provided in or close to the pockets at the respective inlets.

The apparatus can further comprise means (such as one or more staplers and/or sewing machines) for applying mechanical connectors to sheets subsequent to deposition of sheets onto the carriers of the first conveyor.

The third conveyor is preferably rotatable about at least one horizontal axis.

The pockets of the third conveyor can be provided with abutments for the fold lines of the sheets therein, and such abutments are remote from the respective inlets.

The pockets of the third conveyor can be mounted for rotation about the at least one horizontal axis and can extend substantially radially of such axis. Each pocket can include a first wall and a second wall which latter is pivotable relative to the first wall about a second axis, which is preferably at least substantially parallel to the at least one horizontal axis, to thereby open or close the respective inlet. The third conveyor includes or cooperates with means for pivoting the second walls of the pockets relative to the respective first walls. The pivoting means can include means for biasing the second walls in directions to close the respective inlets.

In accordance with a presently preferred embodiment of the improved apparatus, each withdrawing means of the third conveyor further comprises a rotary withdrawing element at the inlet of each pocket and means for rotating the withdrawing elements about third axes which are or can be at least substantially parallel to the at least one horizontal axis. Each withdrawing element can comprise a plurality of spaced-apart coaxial discs, and the rotating means can comprise shafts, one for the discs of each withdrawing element. The first walls of the pockets have surfaces which confront the respective second walls, and the withdrawing elements are preferably provided with peripheral recesses or notches which are at least substantially flush with the surfaces of the respective first walls at the discharge end of the second path. The locating means can include stops which are provided in the recesses of the respective withdrawing elements. If one panel of each sheet includes a portion which projects beyond the other panel in a direction away from the respective fold line, the withdrawing elements can be provided with surfaces which are disposed in the respective recesses and each of which is adjacent the projecting portion of the one panel of the sheet in the respective pocket when such sheet engages the respective stop. The spreading means of each withdrawing device can comprise means for releasably clamping the projecting portion of the one panel of the sheet in a pocket of the third conveyor against the surface in the recess of the respective withdrawing element. The spreading means can comprise or constitute tongs each having a first jaw forming part of the respective withdrawing element and a second jaw including or constituting the respective clamping means. Still further, the spreading means can include means for biasing the clamping means toward the surfaces of the respective withdrawing elements and means for moving the clamping means away from the surfaces of the respective withdrawing elements. The means for moving the clamping means relative to the surfaces of the respective withdrawing elements can comprise a closed grooved cam extending all around the at least one horizontal axis.

The rotating means of the withdrawing means can comprise a shaft for each withdrawing element and means for rotating the shaft about the respective third axis. The means for rotating the shafts can include a cam and followers which are connected to the shafts and track the cam in response to rotation of the third conveyor about the at least one horizontal axis. The means for rotating the shafts can further comprise gear trains each including a first gear on the shaft and a second gear which mates with the first gear and receives torque from the respective follower. At least one gear of each gear train can include or constitute a gear segment.

The means for rotating the withdrawing elements can include means for biasing the withdrawing elements to predetermined angular positions with reference to the respective third axes.

The withdrawing means can further comprise at least one idler roller which is provided on the second wall of each pocket at the respective inlet to bear against a sheet in the respective pocket in closed position of the respective inlet. The inlets can be defined by the respective withdrawing elements and the adjacent idler rollers. The withdrawing means can comprise springs or other suitable means for biasing the second wall of each pocket toward the respective first wall to thereby urge the idler rollers toward the adjacent withdrawing elements.

The third conveyor can further comprise means for adjusting the second axes relative to the respective first walls, for example, in order to adjust the apparatus for the manipulation of thicker, thinner or medium thick sheets.

The means for pivoting the second walls of the pockets in directions to open the respective inlets can include a cam and follower means, with the follower means connected to the second walls and tracking the cam. The apparatus can further comprise means for adjusting the cam relative to the third conveyor in directions to influence the opening and closing of the inlets.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF THE PREFERRED EMBODIMENTS

Figure 1:
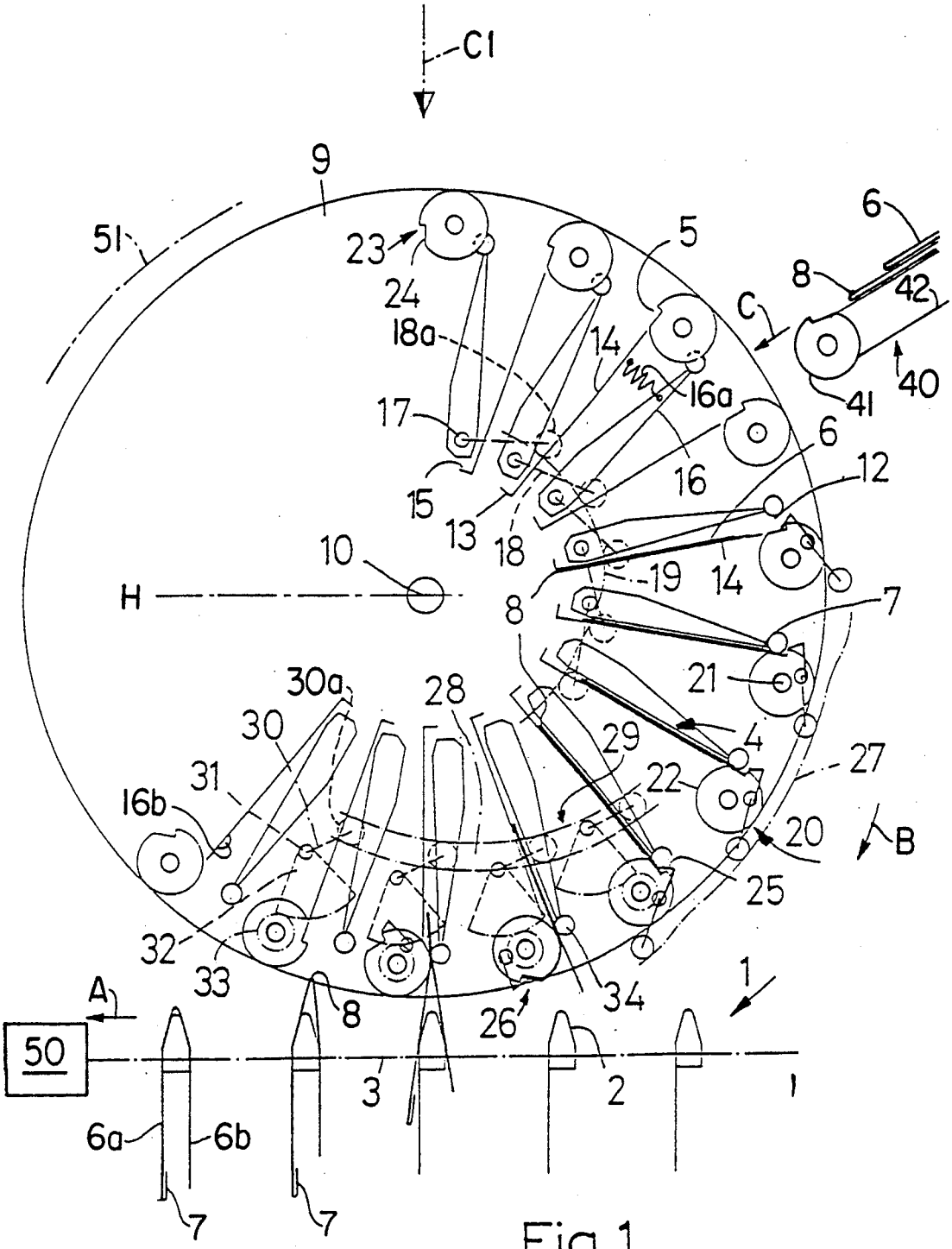
FIG. 1 is a fragmentary schematic elevational view of an apparatus which embodies one form of the invention, a second position of the second conveyor being indicated by a broken-line arrow.

FIG. 1 shows a portion of an apparatus for manipulating openable or spreadable folded sheets 6 of the type having two overlapping panels or pages 6*a*, 6*b* which are joined to each other along an elongated fold line 8. The panel 6*a* of each folded sheet 6 is somewhat wider than the other panel 6*b* in that it includes a portion 7 (sometimes called overlay fold) extending in a direction away from the fold line 8 and beyond the adjacent edge of the panel 6*b*. The sheets 6 must be opened (spread out), i.e., their panels 6*a*, 6*b* must be at least slightly folded or moved apart, prior to deposition on successive saddle-like carriers 2 of an endless first conveyor or gathering conveyor 1. The latter further comprises one or more flexible elements in the form of endless chains, cords, ropes or cables 3 which move (pull) the carriers 2 along an endless first path in the direction of arrow A. The carriers 2 of the illustrated gathering conveyor 1 are equidistant from each other and extend transversely of the direction which is indicated by the arrow A. Each such carrier gathers two or more superimposed sheets 6 (each carrying different printed matter) before the thus obtained stacks or piles of superimposed sheets reach a connecting station for an apparatus 50 having one or more staplers, sewing machines and/or other components for mechanically connecting the superimposed sheets of successive stacks or piles of sheets to each other. Reference may be had, for example, to commonly owned U.S. Pat. No. 4,735,406 granted Apr. 5, 1988 to Walter Weber for "Machine for making brochures and the like".

The improved apparatus further comprises a second conveyor 40 including one or more endless belts 42 which advance a file or a like series of sheets 6 (e.g., an imbricated stream of partially overlapping sheets and hereinafter called file for short) along a downwardly sloping path in the direction of arrow C. The discharge end 41 of the second path is adjacent the path of orbital movement of inlets 12 of a series of pockets 4 which extend radially of the horizontal axis of a shaft 10 serving as a means for rotating a third conveyor 11 constituting a means for transporting successive sheets 6 of the file of sheets, delivered by the conveyor 40, from the discharge end 41 of the second path, along an arcuate third path in the direction of arrow B and to a selected portion of the first path (for the carriers 2). The direction of movement of successive sheets 6 in the pockets 4 of the substantially turret-shaped conveyor 11 is at right angles to the direction of movement (arrow C) of sheets 6 on the upper reach or reaches of the endless belt or belts 42 of the conveyor 40. The pockets 4 of the conveyor 11 (hereinafter called turret for short) extend substantially radially of the horizontal axis which is defined by the shaft 10.

The conveyor 40 can receive sheets 6 from a printing press (not shown), from a magazine (not shown) or from any other suitable source.

The direction of advancement of sheets 6 in the pockets 4 which approach the path for the carriers 2 (i.e., which approach the upper reach of the endless conveyor 1) coincides, at least substantially, with the direction of movement of the carriers 2. Each carrier 2 can support one or more superimposed partially spread out sheets before it reaches the transfer station between the turret 11 and the conveyor 1, or each such carrier can receive one or more sheets on top of the sheet 6 which is delivered by a pocket 4 between the aforementioned transfer station and the connecting apparatus 50.

The conveyor 40 propels successive sheets 6 of the file of sheets on the upper reach or reaches of its belt(s) 42 in the direction of arrow C in such orientation that the fold lines 8 constitute the leaders of the sheets which advance through the then open inlets 12 of the respective pockets 4 and thereupon in the direction of arrow B toward the transfer station between the turret 11 and the conveyor 1. A sheet 6 which has entered the registering pocket 4 at the transfer station between the conveyor 40 and the turret 11 advances toward the shaft 10 and comes to a halt when it reaches an abutment 15 in or close to the radially innermost portion of the respective pocket. The thus introduced sheets 6 then tend to move radially of and away from the shaft 10 under the action of centrifugal force and gravity so that the portions 7 of their wider panels 6 come into engagement with and are arrested by locating means in the form of stops 5 at the inlets 12 of the respective pockets. This ensures that each sheet 6 is located at an optimum distance from the axis of the shaft 10 not later than at the time of spreading and simultaneous withdrawal from the respective pocket for the purpose of deposition on the adjacent carrier 2 so that the partially spread out opened sheet straddles the carrier and advances therewithin the direction of arrow A. Spreading of the sheets 6 which are in the process of being withdrawn from their pockets 4 involves engagement of projecting portions 7 of the respective wider panels 6*a* and separation of those parts of the panels 6*a*, 6*b* which are remote from the respective fold line 8.

The arrow C1 indicates in FIG. 1 another acceptable location for the conveyor 40 or an analogous conveyor. It will be noted that the illustrated conveyor 40 is located at a level above a horizontal plane H which includes the axis of the shaft 10. The same would hold true for a conveyor which would replace the conveyor 40 and would be installed at the location indicated by the arrow Cl. On the other hand, that portion of the first path (for the carriers 2) wherein the pockets 4 are relieved of their sheets 6 is located at a level below that of the plane H including the horizontal axis of the shaft 10.

The inlets 12 of the pockets 4 are open during advancement at the transfer station between the conveyor 40 and the turret 11 5, and such inlets are thereupon closed during sidewise transport of sheets 6 between the walls 14, 16 of the respective pockets toward the oncoming carriers 2. The arrangement is such that the sheets 6 can be withdrawn from their pockets 4 not earlier than when the projecting portions 7 of their wider panels 6*a* reach the respective locating means or stops 5.

The turret 11 comprises two circular disc-shaped end walls 9 which are mounted on and can be driven by the shaft 10, and the pockets 4 are disposed between the two end walls 9 and are equidistant from each other, the same as the carriers 2 of the conveyor 1. The aforementioned abutments 15 for the fold lines 8 of sheets 6 in the respective pockets 4 (each of which can extend all the way between the two end walls 9) can be established by suitably bent radially innermost portions 13 of the respective walls 14, and each of these walls can be fixedly secured to the end walls 9 of the turret 11. The other wall 16 of each pocket 4 is pivotable relative to the respective wall 14 about the axis of a discrete shaft 17 which is parallel to the shaft 10 serving to rotate the end walls 9. The wall 14 of each pocket 4 is located ahead of the respective pivotable wall 16, as seen in the direction of arrow B. The walls 16 of the pockets 4 are pivotable relative to the respective walls 14 for the purpose of opening or closing the corresponding inlets 12. The means for moving (pivoting) the walls 16 relative to the adjacent walls 14 comprises levers 18 which are affixed and extend substantially at right angles to the respective walls 16 and carry roller followers 18*a* to track the face of a preferably adjustable cam 19 surrounding the shaft 10 between the end walls 9. The central portions of the end walls 9 can be said to constitute the hub of the turret 11. The cam 19 is stationary when the turret 5 is in actual use; however, this cam can be adjusted relative to the shaft 10 and/or relative to the levers 18 and followers 18*a* in order to take into consideration certain parameters of the sheets 6. For example, the cam 19 will be adjusted (or the adjustment can involve replacement of the illustrated cam 19 with a differently dimensioned and/or configurated cam) if a file of relatively thin sheets 6 is followed by a file of thicker sheets or vice versa. The means for moving (pivoting) the walls 16 further includes springs (one shown schematically at 16*a*) which are designed to react against the frame of the turret 11 and to bias the walls 16 in directions to close the respective inlets 12. Thus, the arrangement may be such that the levers 18, their followers 8*a* and the cam 19 together constitute an assembly for moving (when necessary) the pivotable walls 16 in directions to open the inlets 12 whereas the springs 16*a* constitute an assembly which normally tends to maintain the walls 16 in angular positions corresponding to closed positions of the respective inlets 12.

The minimum distance between each pivotable wall 16 and the respective non-pivotable wall 14 (at a location remote from the shaft 10) can be determined by suitable distancing elements (one shown at 16*b*) which can be engaged by the adjacent walls 16 or by suitable stops on the one or the other end wall 9.

The inlets 12 of the pockets 4 can remain closed or nearly closed all the way during transport of such pockets and of the sheets 6 therein from the discharge end 41 of the path defined by the conveyor 40 toward and even beyond the locus of transfer of partially spread out sheets onto the adjacent carriers 2. Alternatively, the configuration of the cam 19 can be such that the inlets 12 are also opened, for a short interval of time, at the transfer station between the turret 11 and the conveyor 40.

As can be seen in FIG. 1, the inlets 12 of successive pockets 4 are closed at the level of or close to the horizontal plane H which includes the axis of the shaft 10, i.e., the axis of rotation of the turret 5. It is considered advisable to close the inlets 12 shortly or immediately after propulsion of sheets 6 into the respective pockets 4 because opening of the inlets entails the admission of a certain quantity of air (due to the ventilating effect of the rotating turret 11) and such air would be likely to press the sheets 6 against the pivotable walls 16 and/or would cause the sheets to float in the respective pockets 4. In either event, the sheets 6 would be less likely to move radially outwardly so that the projecting portions 7 of their wider panels or pages 6*a* would engage the respective locating means or stops 5. Adjustability or replaceability of the cam 19 (i.e., of the means for opening the inlets 12) is desirable and advantageous on the additional ground that the extent and/or duration of opening of the inlets 12 can be altered if the currents of air entering the pockets 4 create problems in connection with desired movement of sheets into engagement with the stops 5.

Figure 2:
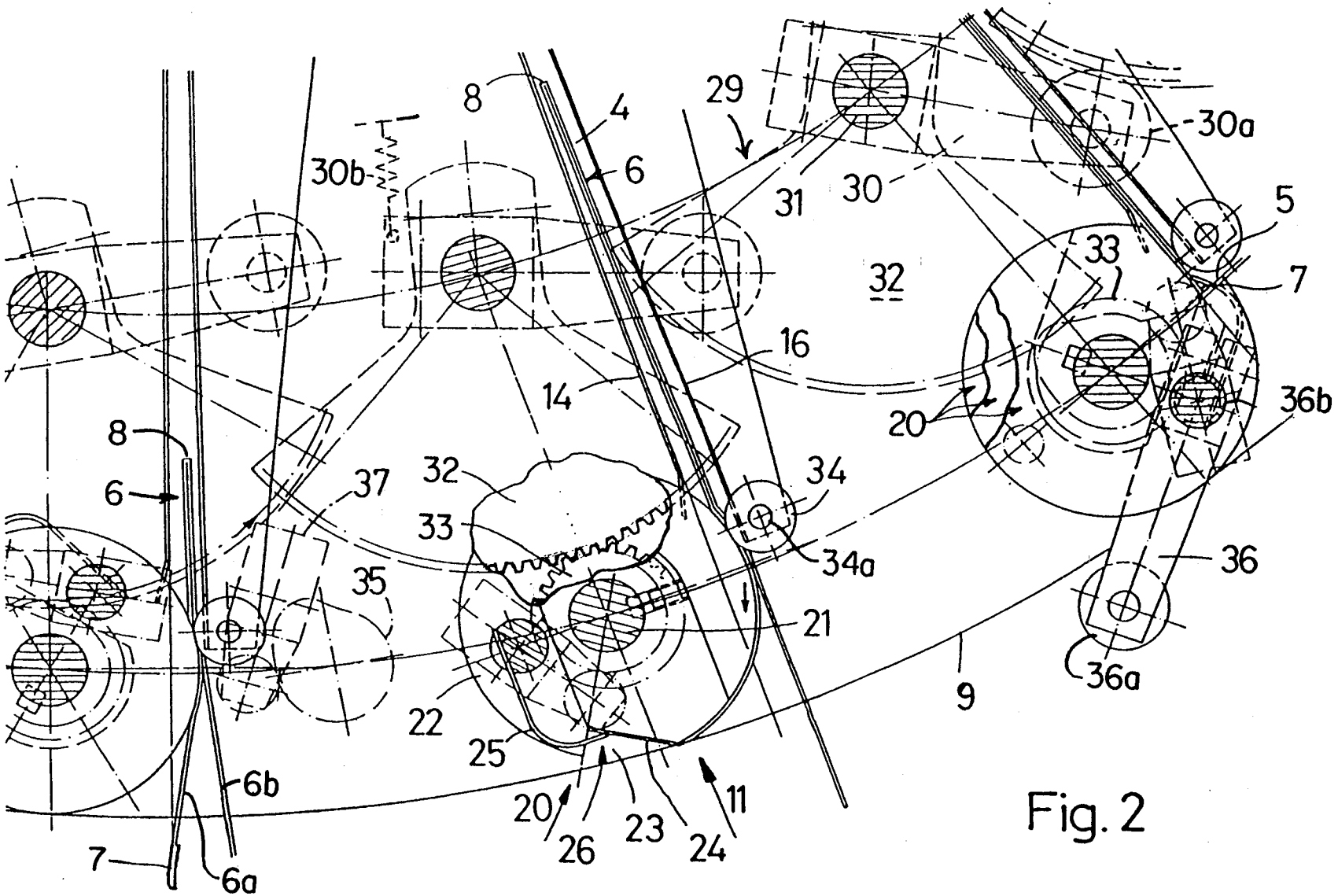
FIG. 2 is an enlarged partly elevational and partly sectional view of a detail in the third conveyor of the apparatus which is illustrated in FIG. 1.

FIGS. 1 and 2 show that the sheets 6 which abut the respective stops 5 lie flat against those surfaces (14*a*) of the walls 14 which confront the adjacent pivotable walls 16. It is clear that the functions of the walls 14 and 16 can be reversed without departing from the spirit of the invention, i.e., the sheets 6 can lie flat against the walls 16 while abutting the respective stops 5 preparatory to partial spreading out and withdrawal from the respective pockets 4. The important factors in determining the timing of radially outward movement of sheets 6 away from the abutments 15 under the action of gravity and/or centrifugal force (so that the projecting portions 7 of the wider panels 6a move toward and ultimately abut the respective stops 5) are the inclination or orientation of sheets in the respective pockets 4 and the rotational speed of the shaft 10.

The turret 11 is provided with a discrete sheet withdrawing and opening device or unit 20 (hereinafter called withdrawing device for short) for each of the pockets 4, and each such withdrawing device is installed between the end walls 9 at the inlets 12 of the respective pockets. Each withdrawing device 20 comprises a composite rotary withdrawing element including a set of coaxial discs 22 and means for rotating the discs about axes which are parallel to the axis of the shaft 10. The rotating means comprises shafts 21 which are rotatably journalled in the end walls 9 of the turret 11 and each of which can carry a battery of spaced-apart coaxial discs 22. The discs 22 of each withdrawing element have aligned peripheral recesses or notches 23, and the stops 5 are disposed in such recesses. A portion of each recess 23 is bounded by a plane surface of facet 24 flush with that surface (14a) of the adjacent wall 14 which confronts the respective pivotable wall 16 when the discs 22 advance past the discharge end 41 of the path defined by the conveyor 40.

Once a sheet 6 has been caused to move radially outwardly away from the abutment 15 and toward and into engagement with the respective stop 5, the projecting portion 7 of the wider panel 6a of such sheet lies flat against the adjacent surface 14a of the wall 14 as well as against the surfaces 24 in the recesses 23 of the adjacent discs 22. The projecting portions 7 are then in optimum positions to be engaged by resilient clamping jaws 25 (see particularly FIG. 2). The clamping jaws 25 form part of tongs 26 each of which further includes the adjacent portions of the respective discs 22. The tongs 26 can releasably clamp the projecting portions 7 to the respective surfaces 24 preparatory to partial spreading out and simultaneous withdrawal of sheets 6 from their respective pockets 4. Those portions of the jaws 25 which are affixed to the discs 22 of the respective withdrawing elements can be said to constitute means for yieldably biasing the jaws 25 toward the adjacent surfaces 24, and the withdrawing devices 20 further comprise means for moving the jaws 25 away from engagement with projecting portions 7 which abut the adjacent surfaces 24. Such moving means includes a stationary cam 27 which is outwardly adjacent the path of movement of inlets 12 between the discharge end 41 and the conveyor 1 and is tracked by roller followers 36a mounted on levers 36 which, in turn, are affixed to turnable shafts 36b installed in the adjacent discs 22 and mounting the respective jaws 25. The construction of the means for actuating the tongs 26 is such that these tongs are open during advancement past the discharge end 41 so that the conveyor 40 can propel successive sheets 6 of the file on the belt or belts 42 into successive pockets 4. Furthermore, each of the tongs 26 remains in open position (the jaws 25 are spaced apart from the respective surfaces 24) until after the projecting portions 7 of the wider panels 6a reach the respective stops 5, i.e., when such projecting portions 7 overlie the respective surfaces 24. The tongs 26 are then closed by the resilient portions of their jaws 25 (and/or by additional springs or the like) to clamp the projecting portions 7 on their way toward the conveyor 1, namely toward the locus where the steps of spreading out and withdrawing successive sheets 6 from their respective pockets 4 begin. In the apparatus of FIG. 1, such locus is at the lower end of the stationary cam 27 where the jaws 25 can move away from the adjacent surfaces 24. The cam 27 is preferably adjustable in or counter to the direction of arrow B and/or radially of the shaft 10. Alternatively, the illustrated cam 27 can be replaced with any one of a set of spare cams (not shown) which can be furnished with the improved apparatus to enhance its versatility and to shorten the interval which is required to change the setup.

Renewed opening of the tongs 26 at the transfer station between the turret 5 and the gathering conveyor 1 is or can be effected by a further mechanism which, as can be seen in FIG. 2, comprises an additional stationary (but preferably adjustable) cam 35 which is then in form-locking engagement with the oncoming clamping jaw 25. The cam 35 is preferably installed on that end wall 9 of the turret 11 which is remote from the observer of FIG. 1 or 2. The cam 35 is engaged by the oncoming jaw 25 (or by an extension of such jaw) in response to turning of the respective shaft 21 by a mechanism 29 including a stationary cam 28 and a gear train between the cam 28 and the respective shaft 21. Each gear train includes a first gear 33 on the respective shaft 21 and a second gear 32 (shown as a gear segment) which mates with the gear 33 and is provided with a lever or arm 30 having a roller follower 30a tracking the cam 28. A further lever 37 is provided with a follower to track the lobe or lobes of the opening cam 35.

It is clear that the aforedescribed means for actuating the jaws 25 of the tongs 26 constitute but one form of such actuating means. It is equally possible to provide a stationary cam adjacent the path of movement of the one and/or the other end wall 9 and to provide each jaw 25 with a suitable follower which tracks the externally mounted cam to ensure that the tip of each jaw 25 is maintained in an optimum position relative to the adjacent surfaces 24 during each and every stage of angular movement of the pockets 4 about the axis of the shaft 10. The externally mounted cam (a portion of such cam is indicated by a phantom line 51) can constitute a circumferentially complete groove cam for followers in the form of rollers or the like which are attached to and can pivot the jaws 25 during certain stages of orbital movement of the jaws 25 about the axis of the shaft 10. The cam 51 can be adjusted and/or replaced to ensure movements of the jaws 25 relative to the adjacent surfaces 24 during accurately determined stages of orbital movement of the tongs 26 about the axis of the shaft 10.

As mentioned above, the sheets 6 are partially spread out (by moving the projecting portions 7 of their wider panels 6a away from the adjacent portions of the respective narrower panels 6b) during withdrawal from the respective pockets 4. Such (partial) spreading of the sheets 6 is necessary in order to ensure that each sheet 6 can be properly deposited on the oncoming carrier 2, either directly or on top of one or more previously deposited sheets. It is also possible to move that portion of each panel 6b which is remote from the respective fold line 8 away from the adjacent projecting portion 7 and/or to spread out each sheet 6 in such a way that both its panels are moved away from one another in the region of the respective projecting portion 7. Still further, the orientation of sheets 6 in the file on the belt or belts 42 of the conveyor 40 can be changed by 180° so that the wider panels 6a are located in front of the respective narrower panels 6b during transport of sheets 6 from the discharge end 41 toward the conveyor 1.

The mechanism 29 for rotating the shafts 21 of successive withdrawing devices 20 for the purpose of withdrawing sheets 6 from their pockets 4 comprises aforementioned stationary cam 28 and the aforementioned gear trains 32, 33. The gear segments 32 are pivotable at 31 and carry levers or arms 30 with roller followers 30a tracking the cam 28. The length of the cam 28 is selected in such a way that it enables the gear trains 32, 33 to rotate the shafts 21 through angles which are necessary to enable the discs 22 to effect complete withdrawal or expulsion of sheets 6 from their pockets 4. Springs 30b are provided to bias the levers 30 in directions to return the shafts 21 and the discs 22 thereon to their starting positions when the withdrawal of sheets 6 from the respective pockets 4 is completed. Such springs can be omitted if the cam 28 is a circumferentially complete groove cam which extends all the way around the shaft 10 (i.e., along an angle of 360°) and is configurated to ensure desirable angular positioning of the shafts 21 during each and every stage of orbital movement of these shafts about the axis of the shaft 10.

Each withdrawing device 20 further comprises a single idler roller 34 or a battery of coaxial idler rollers which are mounted on the pivotable walls 16 at the respective inlets 12 and cooperate with the discs 22 of the adjacent withdrawing elements to positively extract the sheets 6 from their pockets 4. The idler rollers 34 of each withdrawing device 20 can be mounted on a common shaft 34a which is parallel to the adjacent shaft 31. The idler rollers 34 are spaced apart from the adjacent discs 22 when the respective inlets 12 are open; however, they move nearer to the adjacent discs 22 in response to pivoting of the respective walls 16 in directions to reduce the width of the inlets 12; this enables the idler rollers 34 to cooperate with the adjacent discs 22 and to more or less positively extract the sheets 6 from their pockets 4.

FIG. 1 shows that the withdrawing devices 20 are reset to their starting positions upon withdrawal of sheets 6 and while the inlets 12 of the respective pockets 4 are open. This reduces the likelihood that the discs 22 (particularly those portions of the discs which are adjacent their recesses 23) could damage the adjacent idler rollers 34 and/or vice versa.

The improved apparatus is susceptible of many additional modifications without departing from the spirit of the invention. For example, the turret-shaped conveyor 11 can be replaced by a chain or by a set of chains trained about two or more spaced apart sprocket wheels. One such sprocket wheel can be mounted on and driven by the shaft 10 so that the pockets which are carried by the chain or chains of such modified conveyor can advance along an arcuate path on their way from the discharge end 41 of the path which is defined by the belt or belts 42 of the conveyor 40 toward the path for the carriers 2 of the conveyor 1.

It is further clear that the improved apparatus can be used to manipulate sheets having panels or pages of identical width. The mode of spreading out or opening sheets with panels of identical width is well known in the art and need not be described here. Reference may be had, for example, to commonly owned U.S. Pat. No. 4,470,588 granted Sep. 11, 1984 to Geiser for "Suction apparatus for opening folded paper sheets or the like" and to commonly owned U.S. Pat. No. 4,491,311 granted Jan. 1, 1985 to Glanzmann for "Apparatus for opening folded sheets using accelerating and decelerating spreader elements".

The connecting apparatus 50 can be installed adjacent the path of carriers 2 forming part of the conveyor 1, or the apparatus 50 can be installed adjacent a separate conveyor, e.g., in a manner described and shown in the aforementioned commonly owned U.S. Pat. No. 4,735,406 to Weber. All patents referred to in this specification are incorporated herein by reference.

An important advantage of the improved apparatus is that it is not necessary to abruptly change the direction of advancement of sheets 6 on their way from the source or sources onto the carriers 2 of the conveyor 1 and thence to the connecting apparatus 50. In fact, the changes in the direction of movement of the sheets 6 are minimal and all such changes in the direction of movement are limited and accurately controlled by the abutments 15 and stops 5 to ensure highly predictable deposition of each of a short or long series of sheets 6 on the carriers 2 of the conveyor 1. Moreover, the just described mode of transporting the sheets 6 greatly reduces the likelihood of any stray movements of the sheets on their way from the source or sources onto the carriers 2; this, in turn, renders it possible to transport the sheets at a high frequency without risking any pile-ups and/or inaccurate deposition of sheets on the carriers 2. All this contributes to higher output of the improved apparatus and to a considerable reduction of the number of rejects.

An advantage of the turret-shaped transporting conveyor 11, or of an analogous conveyor, is that all of the sheets 6 which enter the pockets 4 of this conveyor can orbit about a single axis (of the shaft 10), i.e., it is not necessary to change the orientation of the sheets by turning each such sheet about a separate axis. Moreover, the positions of the sheets 6 in the pockets 4 can be optimized by gravity but primarily by centrifugal force so that it is not necessary to transmit motion individually to any of the sheets which advance from the discharge end 41 to the conveyor 1. The walls 14, 16 of the pockets 4, the end walls 9 of the conveyor 11, the abutments 15 and the stops 5 provide adequate guidance and confinement for the sheets 6 to ensure optimal positioning of each sheet relative to its pocket at the time the respective withdrawing device 20 is set in operation to proceed with the spreading and evacuation of a sheet from the corresponding pocket.

Though it is possible to replace the discs 22 and the idler rollers 34 of the withdrawing devices 20 with tongs or with other relatively complex sheet withdrawing means, the illustrated withdrawing devices 20 are preferred at this time due to their simplicity, compactness, reliability and low cost.

The tongs 26 can be replaced with suction cups or with other suitable clamping means without departing from the spirit of the invention. Furthermore, the stops 5 can be replaced with outerwise configurated and/or mounted stops.

The pivotal movements of the walls 16 are controlled in such a way that the idler rollers 34 at the radially outer ends of these walls cannot interfere with radially outward movements of sheets 6 toward and into engagement with the stops 5, but the idler rollers can cooperate with the adjacent sets or batteries of discs 22 to reliably withdraw properly positioned sheets 6 from their respective pockets 4 and to deposit the withdrawn sheets on the adjacent carriers 2. As mentioned above, the bias of the springs 16*a* for the pivotable walls 16 can be relied upon to urge the idler rollers 34 against the adjacent discs 22, and more particularly against the sheets 6 which are to be evacuated from their pockets 4 subsequent to accurate positioning as a result of engagement with the respective stops 5.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for manipulating spreadable folded sheets each of which has overlapping panels joined to each other along a fold line, comprising a first conveyor having a plurality of spaced-apart carriers and means for moving the carriers in a first direction along a first path; a second conveyor having means for advancing a file of folded sheets in a second direction along a second path wherein the fold lines constitute the leaders of the respective sheets and which has a discharge end remote from said first path; and a third conveyor having pockets and means for transporting said pockets along a third path which extends from said discharge end to said first path and wherein the pockets move at least substantially in said first direction, at least at said first path, each of said pockets having a sheet-admitting inlet and said third conveyor further comprising means for opening the inlet not later than at said discharge end to admit a sheet into the pocket and for closing the inlet between said discharge end and said first path, said third conveyor also comprising means for withdrawing sheets from said pockets, for spreading the sheets and for depositing the spread out sheets on said carriers, said withdrawing means including means for locating each sheet in the respective pocket while the respective inlet is closed and prior to spreading of the sheet; said third conveyor being rotatable about a predetermined axis and each of said pockets comprising a first wall, a second wall pivotable relative to the first wall about a second axis, which is at least substantially parallel to said predetermined axis, so as t open or close the respective inlet, and means for pivoting said second walls including means for pivoting said second walls in directions to open the respective inlets including a cam and follower means connected to said second walls and tracking said cam; and further comprising means for adjusting said cam relative to said third conveyor in directions to influence the opening and closing of said inlets.

2. The apparatus of claim 1 wherein said pockets extend substantially radially of said predetermined axis.

3. The apparatus of claim 1, said first walls having surfaces confronting the respective second walls and said withdrawing elements having peripheral recesses at least substantially flush with the surface of the respective first walls at the discharge end of said second path, said locating means including stops provided in the recesses of the respective withdrawing elements.

4. The apparatus of claim 3, wherein said means or moving said clamping means away from the surfaces of the respective withdrawing elements comprise a closed grooved cam extending all around said predetermined axis.

5. Apparatus for manipulating spreadable folded sheets each of which has overlapping panels joined to each other along a fold line, comprising a first conveyor having a plurality of spaced-apart carriers and means for moving the carriers in a first direction along a first path; a second conveyor having means for advancing a file of folded sheets in a second direction along a second path wherein the fold lines constitute the leaders of the respective sheets and which has a discharge end remote from said first path; and a third conveyor having pockets and means for transporting said pockets along a third path which extends from said discharge end to said first path and wherein the pockets move at least substantially in said first direction, at least at said first path, each of said pockets having a sheet-admitting inlet and said third conveyor further comprising means for opening the inlet not later than at said discharge end to admit a sheet into the pocket and for closing the inlet between said discharge end and said first path, said third conveyor also comprising means or withdrawing sheets from said pockets, for spreading the sheets and for depositing the spread out sheets on said carriers, said withdrawing means including means for locating each sheet in the respective pocket while the respective inlet is closed and prior to spreading of the sheet; said third conveyor being rotatable about a predetermined axis and each of said pockets comprising a first wall, a second wall pivotable about a second axis which is at least substantially parallel to the predetermined axis, to open or close the respective inlet, said third conveyor further comprising means for adjusting said second axes relative to the respective first walls.

6. The apparatus of claims 5 or 1, wherein said carriers include saddles extending transversely of said first direction and the means for moving said carriers includes means for pulling said saddles in said first direction.

7. The apparatus of claims 5 or 1, wherein said third conveyor defines for said pockets a third path having an arcuate portion between said first and second paths, said pockets extending substantially transversely of said third path to change the orientation of sheets therein during transport from said discharge end to the carriers in said first path.

8. The apparatus of claims 5 or 1, wherein said locating means comprise stops provided at said pockets adjacent the respective inlets.

9. The apparatus of claims 5 or 1, further comprising means for applying mechanical connectors to sheets subsequent to deposition of sheets onto the carriers of said first conveyor.

10. The apparatus of claims 5 or 1, wherein said third conveyor is rotatable about a substantially horizontal axis.

11. The apparatus of claims 5 or 1, wherein said pockets have abutments for the fold lines of the sheets therein, said abutments being remote from the respective inlets.

12. The apparatus of claim 5, wherein said third conveyor pockets extend substantially radially of said predetermined axis, and means for pivoting the second walls of said pockets relative to the respective first walls.

13. The apparatus of claim 12, wherein said pivoting means includes means for biasing said second walls in directions to close the respective inlets.

14. Apparatus for manipulating spreadable folded sheets each of which has overlapping panels joined to each other along a fold line, comprising a first conveyor having a plurality of spaced-apart carriers and means for moving the carriers in a first direction along a firs t path; an second conveyor having means for advancing a file of folded sheets in a second direction along a second path wherein the fold lines constitute the leaders of the respective sheets and which has a discharge end remote rom said first path; and a third conveyor having pockets and means for transporting said pockets along a third path which extends from said discharge end to said first path and wherein the pockets move at least substantially in said first direction, at least at said first path, each of said pockets having a sheet-admitting inlet and said third conveyor further comprising means for opening the inlet not later than at said discharge end to admit a sheet into the pocket and for closing the inlet between said discharge end and said first path, said third conveyor also comprising means for withdrawing sheets from said pockets, for spreading the sheets and for depositing the spread out sheets on said carriers, said withdrawing means including means or locating each sheet in the respective pocket while the respective inlet is closed and prior to spreading of the sheet; said third conveyor being rotatable about a predetermined axis and said pockets extending substantially radially of said axis, said withdrawing means further comprising a rotary withdrawing element at the inlet of each of said pockets and means for rotating said withdrawing elements about second axes which are at least substantially parallel to said predetermined axis.

15. The apparatus of claims 14 or 1, wherein each of said withdrawing elements comprises a plurality of spaced-apart coaxial discs and said rotating means comprises shafts, one of the discs of each of said withdrawing elements.

16. The apparatus of claim 14, wherein each of said pockets includes a first wall and a second wall pivotable relative to the first wall about an axis which is at least substantially parallel to said predetermined axis, said first walls having surfaces confronting the respective second walls and said withdrawing elements having peripheral recesses at least substantially flush with the surfaces of the respective first walls at the discharge end of said second path, said locating means including stops provided in the recesses of the respective withdrawing elements.

17. The apparatus of claim 16 for manipulating spreadable folded sheets wherein one panel of the respective pair of panels includes portion projecting beyond the other panel in a direction away from the respective fold line, said withdrawing elements having surfaces disposed in the respective recesses and each adjacent the projecting portion of the one panel of the sheet in the respective pocket when such sheet engages the respective stop.

18. The apparatus of claim 17, wherein each of said spreading means comprises means for releasably clamping the projecting portion of the one panel of the sheet in a pocket of said third conveyor against the surface in the recess of the respective withdrawing element.

19. The apparatus of claim 18, wherein each of said spreading means comprises tongs having a first jaw forming part of the respective withdrawing element and a second jaw including the respective clamping means.

20. The apparatus of claim 18, wherein each of said spreading means further comprises means for biasing said clamping means toward the surfaces of the respective withdrawing elements.

21. The apparatus of claim 20, wherein each of said spreading means further comprises means for moving said clamping means away from the surfaces of the respective withdrawing elements.

22. The apparatus of claim 21, wherein said means for moving said clamping means away from the surfaces of the respective withdrawing elements comprise a closed grooved cam extending all around said predetermined axis.

23. The apparatus of claim 14, wherein each of said rotating means comprises a shaft for the respective withdrawing element and means for rotating the shaft about the respective axis, said means for rotating the shafts including a cam and followers connected with said shafts and tracking said cam in response to rotation of said third conveyor about said predetermined axis.

24. The apparatus of claim 23, wherein said means for rotating the shafts further comprises gear trains each including a first gear on each of said shafts and a second gear mating with the first gear and receiving torque from the respective follower.

25. The apparatus of claim 24, wherein at least one gear of each of said gear trains is a gear segment 26. The apparatus of claim 24, wherein each of said rotating means includes means for biasing said withdrawing elements to predetermined angular positions with reference to the respective second axis.

27. The apparatus of claim 14, wherein each of said pockets includes a first wall and a second wall pivotable relative to the first wall about a third axis, which is at least substantially parallel to said predetermined axis, to open and close the respective pocket, said withdrawing means further comprising at least one idler roller provided on each of said second walls at the respective inlet to bear against a sheet in the respective pocket in the closed position of the respective inlet.

28. The apparatus of claim 27, wherein said withdrawing elements and the respective idler rollers define the respective inlets.

29. The apparatus of claim 20, wherein each of said withdrawing means further comprises means for biasing said second walls toward the respective first walls to thereby urge said idler rollers toward the respective withdrawing elements.

* * * * *